United States Patent [19]

Schroeder

[11] Patent Number: 5,037,256

[45] Date of Patent: Aug. 6, 1991

[54] DUNNAGE BAR LOCK

[76] Inventor: Robert C. Schroeder, 7435 Gills Pier Rd., Northport, Mich. 49670

[21] Appl. No.: 445,554

[22] Filed: Dec. 4, 1989

[51] Int. Cl.[5] ..... B61D 45/00

[52] U.S. Cl. ..... 410/143; 410/152; 410/144; 410/34; 403/325; 403/327

[58] Field of Search ..... 410/121, 132, 141–144, 410/146–149, 150, 152–154, 156; 403/325–327; 108/54.1, 55.1; 211/94.5; 292/259 R; 220/534–538, 541–545

[56] References Cited

U.S. PATENT DOCUMENTS

| | | | |
|---|---|---|---|
| 2,806,436 | 9/1957 | Johnston | 410/152 X |
| 2,900,925 | 8/1959 | Dunlap | 410/147 |
| 3,051,099 | 8/1962 | Robertson | 410/152 X |
| 3,078,813 | 2/1963 | Rolfe | 410/147 |
| 3,229,994 | 1/1966 | Klein | 410/144 |
| 3,411,459 | 11/1968 | Hyatt | 410/147 |
| 3,431,015 | 3/1969 | Breen et al. | 410/152 X |
| 3,486,468 | 12/1969 | Bezlaj et al. | 410/141 |
| 3,554,136 | 1/1971 | Falk | 410/129 |
| 3,774,939 | 11/1973 | Freads et al. | 410/149 |
| 3,799,070 | 3/1974 | Munson | 410/149 |
| 3,830,537 | 8/1974 | Brindle | 292/259 |
| 4,074,634 | 2/1978 | Snow et al. | 410/152 |
| 4,079,677 | 3/1978 | Vandergriff et al. | 410/147 |
| 4,256,425 | 3/1981 | Burgess et al. | 410/149 |
| 4,553,888 | 11/1985 | Crissy et al. | 410/144 |
| 4,915,428 | 4/1990 | Hayakawa | 292/DIG. 17 X |

OTHER PUBLICATIONS

Photographs submitted by applicant of previously marketed Dunnage Bar Assembly filed 10/29/90.

*Primary Examiner*—Robert J. Spar
*Assistant Examiner*—Brian K. Dinicola
*Attorney, Agent, or Firm*—Barnes, Kisselle, Raisch, Choate, Whittemore & Hulbert

[57] ABSTRACT

A bar lock arrangement that includes a bar having a rectangular cross section and a lateral opening in one side of the bar adjacent to the end of the bar. A saddle has a base and parallel sidewalls spaced from each other to receive the bar end on the base between the sidewalls. An L-shaped latch has a base positioned beneath the saddle base, a leg that extends upwardly from the saddle base adjacent to the saddle sidewalls, and a finger overlying and spaced from the saddle base by a distance corresponding to the cross sectional dimension of the bar end. The latch is pivotally mounted to the saddle beneath the saddle base, and a coil spring is captured between the saddle and latch bases for urging the latch finger to the position overlying the saddle base. The bar end engages a camming surface on the latch finger for pivoting the latch with respect to the saddle against force of the spring so that the bar end is received within the saddle, with a locating pin on the saddle base received within the opening at the bar end. The bar end is thus locked in position beneath the latch finger and between the saddle sidewalls.

10 Claims, 4 Drawing Sheets

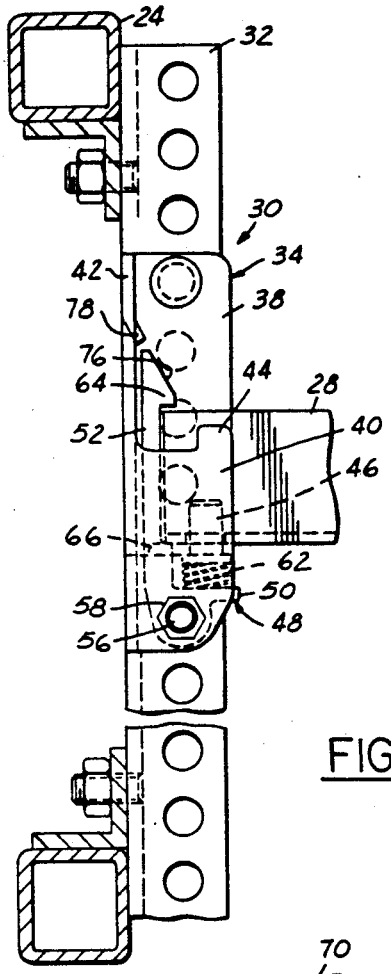
FIG.2
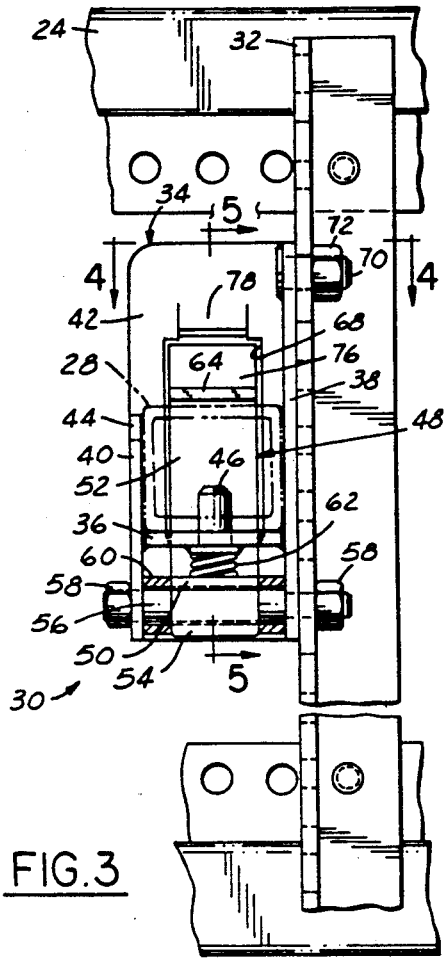
FIG.3
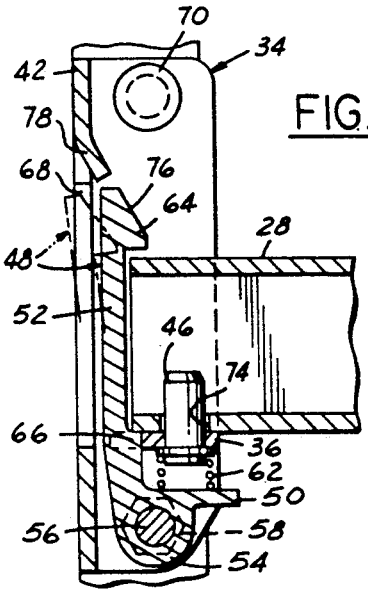
FIG.5
FIG.4
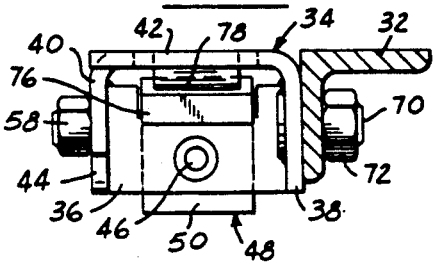

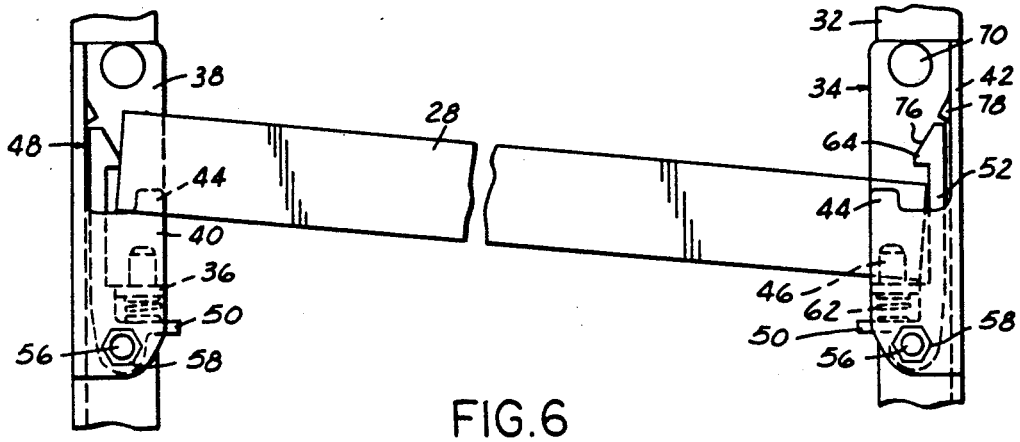
FIG.6
FIG.7
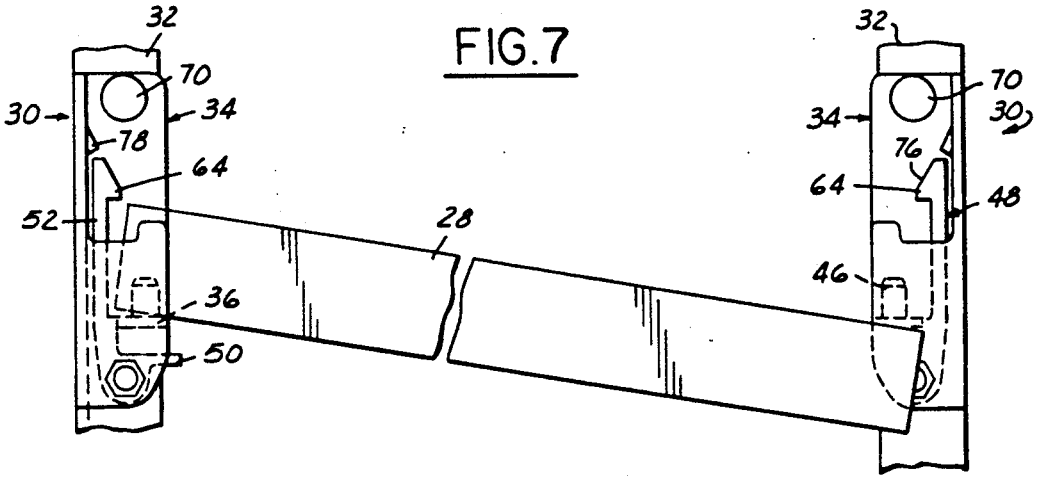
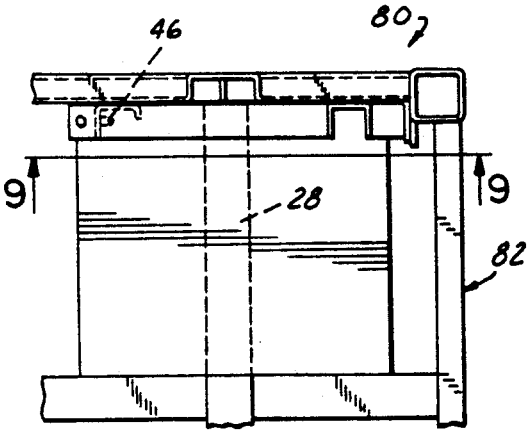
FIG.8
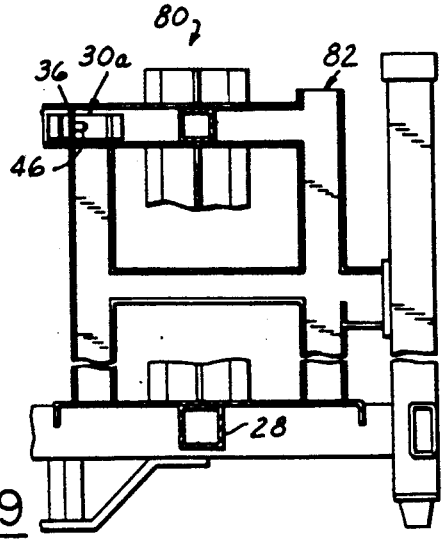
FIG.9

DUNNAGE BAR LOCK

The present invention is directed to bar lock arrangements having particular utility in dunnage and like applications.

BACKGROUND AND OBJECTS OF THE INVENTION

Individual pieces such as automotive door panels are conventionally shipped in a frame having slots for receiving multiple individual pieces and bars for locking the pieces in place. These bars, called dunnage bars in the art, are removably mounted at each end in associated locking devices, which are themselves adjustably positioned on the frame for accommodating pieces of differing geometries. In a dunnage bar locking arrangement heretofore marketed by applicant, the lock includes a saddle having a base and parallel sidewalls spaced from each other by a distance to receive and laterally capture an end of the dunnage bar. A latch is mounted on an endwall of the saddle at a position spaced from the saddle base, and is rotatable on the endwall about an axis parallel to the saddle base between a lower position at which the latch captures the dunnage bar end against the saddle base between the sidewalls, and an upper position that permits removal of the dunnage bar end. A coil spring urges the latch against the saddle endwall and cooperates with a detent integral with a endwall for preventing rotation of the latch from the lower position to the upper position unless the latch is manually biased against the spring force. A cam surface on the detent automatically moves the latch against the spring force as the latch is manually pivoted from the upper to the lower bar-locking position.

Although applicant's prior-art lock arrangement described above has enjoyed substantial commercial acceptance and success, improvements remain desirable. For example, the prior-art lock requires manipulation of the latch by hand at both ends of the bar both to lock and unlock the bar ends, making use of the bar and lock arrangement more time-consuming, cumbersome and expensive than desired. It is therefore a general object of the present invention to provide an improved bar locking arrangement for dunnage applications and the like in which the bar may be inserted into the lock without requiring operator manipulation of the locking device itself. Another object of the present invention is to provide a bar lock arrangement of the described character in which the bar may be removed from the locks by manipulating the lock at one bar end by hand, and then removing the bar without manipulating the lock at the opposing end. A further object of the invention is to provide a bar lock arrangement of the described character that is less expensive to manufacture than are similar arrangements in the prior art, including applicant's prior-art lock arrangement. Yet another object of the invention is to provide a locking arrangement that may be employed in conjunction with the same bars as those employed with the prior-art lock arrangement, thereby reducing the cost of changeover from applicant's existing lock arrangement to that of the present invention.

BRIEF DESCRIPTION OF THE DRAWINGS

The present invention, together with additional objects, features and advantages thereof, will be best understood from the following description, the appended claims and the accompanying drawings in which:

FIG. 2 is a fragmentary side elevational view of a dunnage bar and lock in the frame of FIG. 1;

FIG. 3 is a fragmentary end elevational view of the bar and lock of FIG. 2;

FIGS. 4 and 5 are fragmentary sectional views taken substantially along the respective lines 4—4 and 5—5 in FIG. 3;

FIGS. 6 and 7 are fragmentary side elevational views of a dunnage bar and opposed bar locks in operation assembling (FIG. 6) and disassembling (FIG. 7) the bar from the locks;

FIG. 8 is a fragmentary top plan view of a modified frame and lock arrangement;

FIG. 9 is a fragmentary sectional view taken substantially along the line 9—9 in FIG. 8;

DETAILED DESCRIPTION OF PREFERRED EMBODIMENTS

Figure 1:
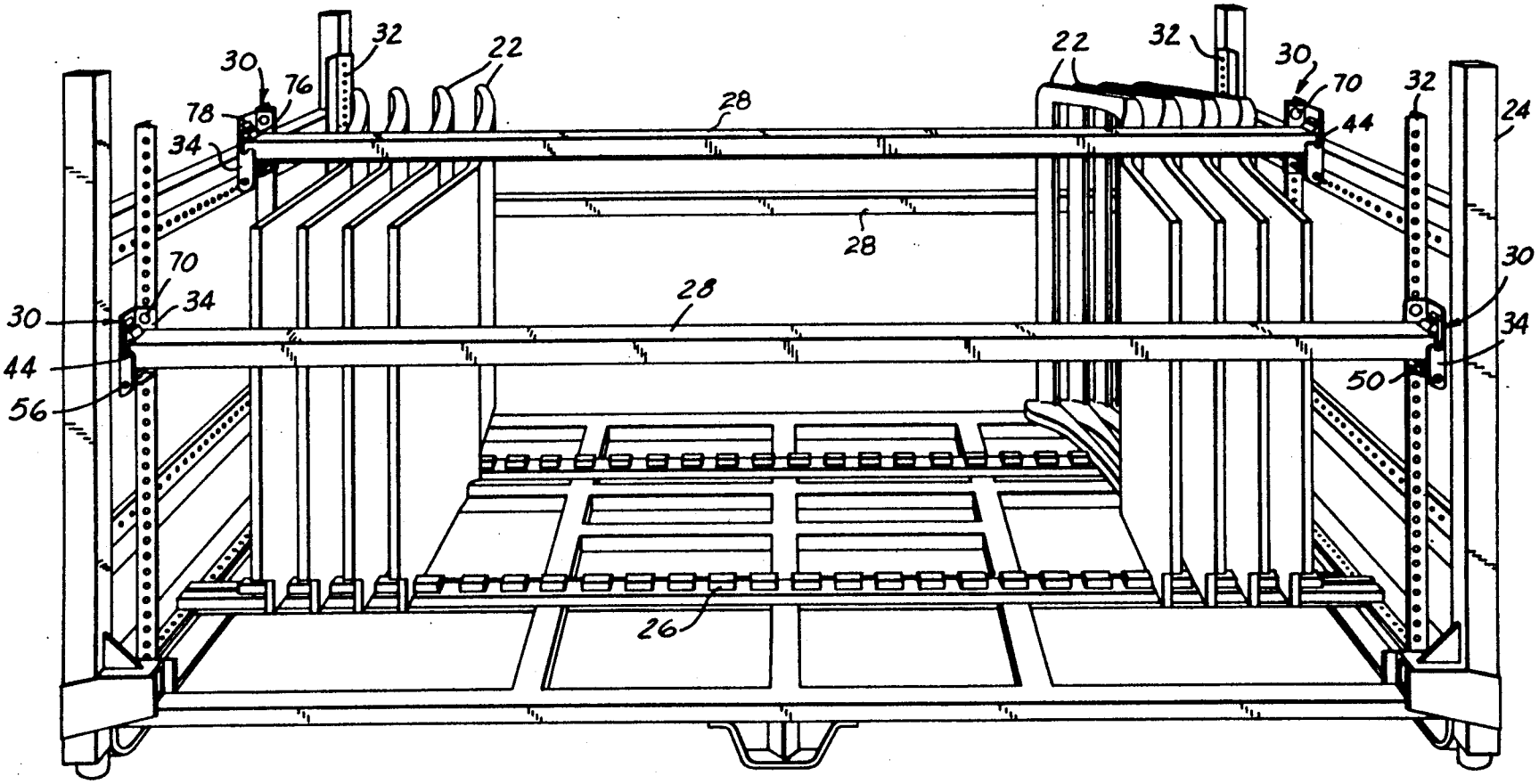
FIG. 1 is an elevational view of a shipping frame for automotive door panels featuring dunnage bars and bar locks in accordance with one presently preferred embodiment of the invention.

FIG. 1 illustrates an assembly 20 for shipping automotive door panels 22, for example, that includes a generally rectangular frame 24 having a bed 26 with individual slots or segments for receiving and holding the bottom edges of panels 22 at positions spaced from each other. Door panels 22 are held in place against bed 26, and separated from each other, by three dunnage bars 28 that engage the side and top edges of panels 22. Each bar 28 is of extruded aluminum stock or the like, having a rectangular, preferably, square cross sectional contour and opposed ends captured within associated dunnage bar locks 30. Bed 26 and locks 30 are adjustably mounted on angle brackets 32 affixed to frame 24 for accommodating panels and other pieces of varying geometry. The present invention is directed to the locking arrangement that includes the combination of dunnage bar 28 and lock 30. In this respect, it will be appreciated that the specific geometries of panels 22 and frame 24 shown in FIG. 1 are for purposes of illustration only.

Referring now to FIGS. 2-5, lock 30 comprises a rectangular bracket or saddle 34 having a base 36 and opposed upwardly projecting parallel sidewalls 38, 40. (It will be appreciated that directional adjectives such as "upward" and "lateral" are employed for purposes of description only with respective to the longitudinal axis of bar 28 and the preferred orientation of lock 30 illustrated in FIGS. 2-5.) Sidewalls 38, 40 are interconnected by a back or end wall 42 opposed to the end of bar 28. Viewed endwise from the direction of bar 28—i.e., in the orientation of FIG. 3—saddle sidewalls 38, 40 and base 36 form a generally J-shaped construction, with sidewall 40 being substantially shorter than sidewall 38 and back wall 42. The top and front of saddle 34 are open. A finger 44 projects upwardly from sidewall 40 at the edge thereof remote from back wall 42. A cylindrical locating pin 46 is affixed to and extends upwardly from saddle base 36.

A generally L-shaped latch 48 has a base 50 positioned beneath saddle base 36, and a leg 52 that extends upwardly from latch base 50 and saddle base 36 between sidewalls 38, 40. Latch base 50 has an integral depending collar 54 with a lateral through-opening that rotatably encompasses an axle 56 extending between saddle sidewalls 38, 40 and fastened thereto by the nuts 58. Spacers 60 (FIG. 3) are captured between latch 48 and sidewalls 38, 40 around axle 56 to center latch 48 between the saddle sidewalls. A coil spring 62 is affixed at one end to the lower end of pin 46 beneath saddle base 36, and is captured in compression between saddle base 36 and latch base 50. A finger 64 at the upper end of latch leg 52 is thus urged by coil spring 62 to the position illustrated in FIGS. 2–4, and in solid lines in FIG. 5, overlying saddle base 36.

A stop 66 on latch leg 52 is positional to abut saddle base 36, as best seen in FIG. 5, to limit inward pivotal motion of latch 48. When stop 66 abuts base 36, saddle base 36 and latch base 50 are parallel to each other, and latch leg 52 is perpendicular to saddle base 36 and parallel to saddle back wall 42. An aperture 68 in back wall 42 accommodates pivotal outward motion of latch 48 about axle 56 against spring 62, as shown in phantom in FIG. 5. A threaded stud 70 projects orthogonally outwardly from the upper end of sidewall 38. Stud 70 and axle 50 receive nuts 72, 58 for mounting lock 30 (FIG. 1) on angle bracket 32. The lock 30 (FIGS. 1 and 6–7) at the opposing end of bar 28 is the mirror image of that hereinabove described.

In use, bar 28 may be assembled to lock 30 by manually pressing latch base 50 upwardly against coil spring 62, and thereby pivoting latch 48 to the position shown in phantom in FIG. 5. The end of bar 28 may then be positioned between saddle sidewalls 38, 40 against saddle base 36, with saddle locating pin 46 received within a corresponding locating opening 74 (FIG. 5) in bar 28 adjacent to the end thereof. Alternatively, and preferably, bar 28 may be positioned, within lock 30 without direct manipulation of latch 48, by sliding the end of bar 28 downwardly against the sloping cam surface 76 at the upper inner end of latch finger 64 so as to cam latch leg 52 into back wall recess 68 and permit entry of bar end 28 between saddle sidewalls 38, 40. When the bar end has cleared latch finger 64, the latch snaps back into the locking position illustrated in FIG. 5. Preferably, saddle back wall 42 is bent inwardly at 78 at the upper end of opening 68 so as to align with latch finger camming surface 76 in the locked or latched position thereof to guide the dunnage bar end to the cam surface. In the locked position of latch 48 illustrated in FIGS. 2–5, latch finger 64 overlies saddle base 36 effectively to prevent removal of the dunnage bar end, particularly in cooperation with pin 46 and dunnage bar opening 74.

In removing dunnage bar 28 from opposed locks 30 (FIGS. 6 and 7), one of the opposed locks must be manipulated by an operator, either by pushing outwardly on latch finger 64 or upwardly on latch base 50, to release one end of the dunnage bar. The dunnage bar end may conveniently be temporarily rested on saddle sidewall 40 by placement of dunnage bar end opening 74 over sidewall finger 44, as shown in FIG. 6. The dunnage bar is disassembled from the opposing lock by dropping the unlocked end beneath the level of the opposing locks until the upper edge of the locked dunnage bar end clears latch finger 64, as shown in FIG. 7, at which point the dunnage bar end may be lifted from lock 30. There is thus provided a dunnage bar locking arrangement in which the dunnage bar may be assembled to the opposing locks and locked in place without direct or hand manipulation of either lock by the operator, and in which the dunnage bar may be disassembled from the opposing locks by manipulation of one lock and removal from the opposing lock without direct operator manipulation of the latter.

Figure 12:
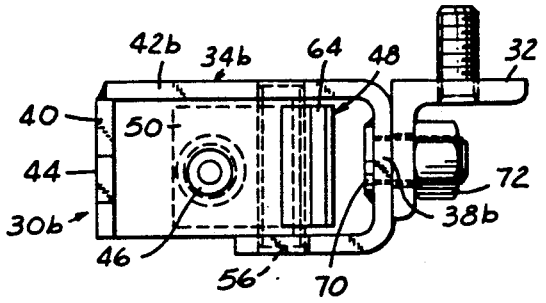
FIG. 12 is a fragmentary top plan view of the lock arrangement illustrated in FIG. 11.
Figure 10:
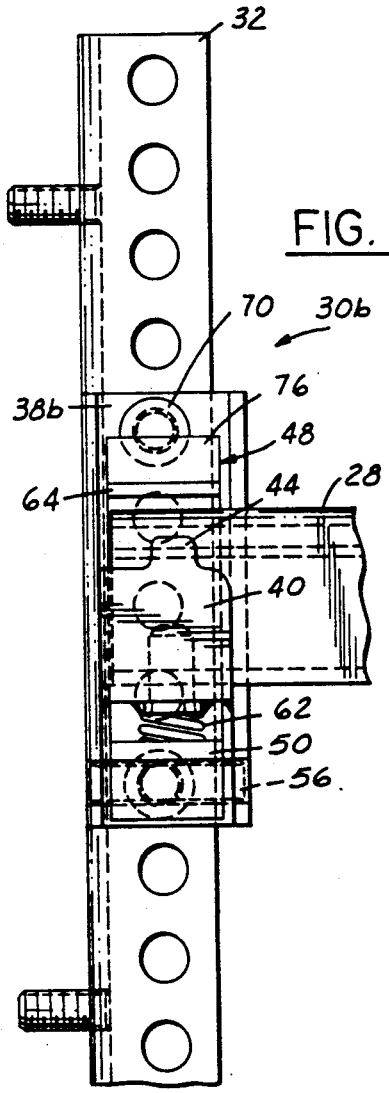
FIG. 10 is a fragmentary side elevational view similar to that of FIG. 2 illustrating another modified embodiment of the invention.
Figure 11:
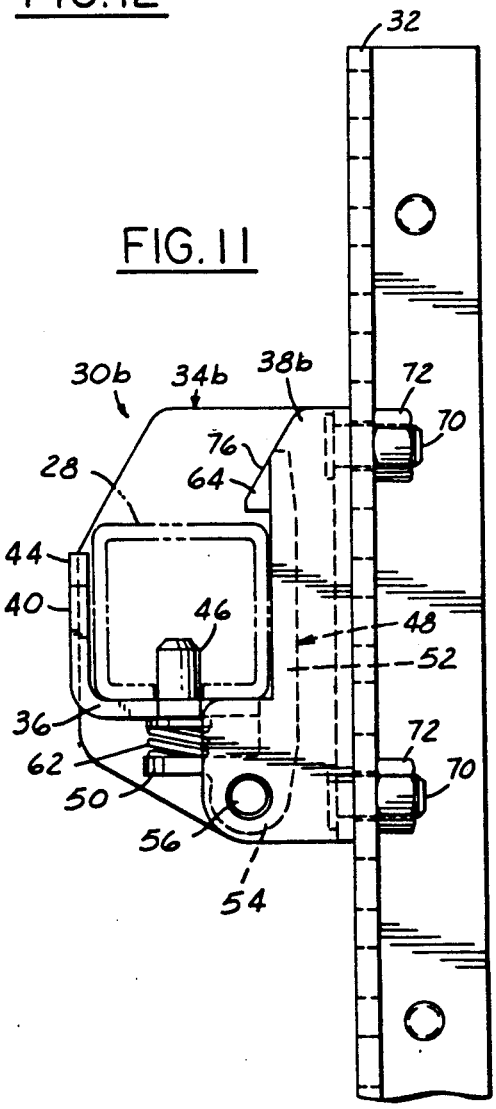
FIG. 11 is a fragmentary end elevational view of the lock arrangement illustrated in FIG. 10.

FIGS. 8 and 9 illustrate a modified lock 30*a* in a shipping assembly 80 in which the frame 82 is of channel construction for removably capturing dunnage bars 28. It will be noted in FIGS. 8 and 9 that lock 30 maybe oriented horizontally rather than vertically, as in FIGS. 1-7, without departing from the principles of the invention in any respect. In the embodiment of FIGS. 8 and 9, the saddle of lock 30 is formed by opposing sidewalls of the frame channel stock, and by the base 36 welded thereacross. FIGS. 10–12 illustrate a modified lock 30*b* that may be employed in conjunction with existing dunnage bars 28. Specifically, in lock 30*b*, latch 48 is positioned within a recess formed in saddle sidewall 38*b*, and the axis of latch pivot axle 56 is parallel to rather then perpendicular to saddle sidewalls 38*a*, 40. Thus, lock 30*b* can accommodate longer dunnage bars 28 than locks 30, 30*a* in FIGS. 1–9. Threaded studs 70 extend from sidewall 38*a* for receiving nuts 72 and mounting lock 30*b* on angle bracket 32. Otherwise, lock 30*b* is identical to lock 30 hereinabove described detail.

The invention claimed is:

1. A dunnage bar lock and frame arrangement that comprises:

an elongate bar having spaced identical ends of rectangular cross sectional contour, a dunnage frame, and a pair of dunnage bar locks mounted on said frame at positions spaced from and opposed to each other removably to receive respective opposed ends of said bar, each of said locks comprising:

a saddle mounted in stationary position on said frame having a saddle base and parallel sidewalls spaced from each other to removably receive an associated bar end on said saddle base between said sidewalls, an L-shaped latch having a latch base positioned beneath said saddle base, a latch leg that extends upwardly from said saddle base adjacent to said sidewalls, and a finger overlying and spaced from said saddle base by a distance corresponding to said contour, means beneath said saddle base pivotally mounting said latch to said saddle, spring means positioned between said saddle base and said latch base urging said latch finger to a position overlying said saddle base, and means for pivotally said latch with respect to said saddle against said spring means to place and remove an associated bar end from within said saddle such that, upon release of said latch, said spring means urges said finger to a position overlying said saddle base and said bar end is captured within said saddle by said latch finger and said saddle bar.

2. The arrangement set forth in claim 1 wherein said pivoting means comprises means on said latch base for manually urging said latch base against said spring.

3. The arrangement set forth in claim 1 further comprising a lateral opening in one side of said bar adjacent to each end thereof, and a pin on each said saddle base for receipt in said opening to lock said bar on said base against motion parallel to said base.

4. The arrangement set forth in claim 3 further comprising means on one of said sidewalls for engagement with said opening to temporarily hold said bar.

5. The arrangement set forth in claim 1 wherein said spring means comprises a coil spring mounted in compression between said latch base and said saddle base.

6. The arrangement set forth in claim 1 wherein said pivoting means comprises cam means on said finger oriented for engagement by said bar end during placement of said bar onto said saddle such that said bar end pivots said latch against said spring means.

7. The arrangement set forth in claim 1 wherein said latch leg is positioned between and perpendicular to said saddle sidewalls.

8. The arrangement set forth in claim 1 wherein one of said sidewalls includes a recess, said latch leg being positioned within said recess opposing the other sidewall.

9. The arrangement set forth in claim 1 wherein said saddle is J-shaped in cross section and has means on the shorter of said sidewalls for engagement with said opening to hold said bar end.

10. The arrangement set forth in claim 1 further comprising studs extending from one of said sidewalls for removably mounting said saddle on said dunnage frame.

* * * * *